US005467484A

United States Patent [19]

Drescher et al.

[11] Patent Number: 5,467,484

[45] Date of Patent: Nov. 21, 1995

[54] NON-SLIP GLOVE

[76] Inventors: Bonnie J. Drescher; Scott M. Drescher, both of 3595 Hwy. NN, West Bend, Wis. 53095

[21] Appl. No.: 165,175

[22] Filed: Dec. 13, 1993

[51] Int. Cl.[6] ..... A41D 19/00

[52] U.S. Cl. ..... 2/161.8; 2/161.6; 2/167

[58] Field of Search ..... 2/161.3, 161.8, 2/159, 161.1, 161.6, 161.7, 163, 168, 161.2, 160, 167

[56] References Cited

U.S. PATENT DOCUMENTS

| | | | |
|---|---|---|---|
| 308,863 | 12/1884 | Worley | 2/161.8 |
| 599,677 | 3/1898 | Alder | 2/168 |
| 970,958 | 9/1910 | Schulherr et al. | 2/162 |
| 1,179,871 | 4/1916 | St. John | 2/161.3 |
| 1,630,730 | 5/1927 | Daugherty | 2/159 |
| 2,694,029 | 11/1954 | Skinner | 2/168 |
| 3,255,462 | 6/1966 | Antonious | 2/161.3 |
| 3,341,861 | 9/1967 | Robbins | 2/167 |
| 3,597,765 | 8/1971 | Stanton | 2/159 |
| 3,649,967 | 3/1972 | Millman | 2/161.3 |
| 4,214,321 | 7/1980 | Nuwayser | 2/159 |
| 4,270,228 | 6/1981 | Gaiser | 2/161.8 |
| 4,555,813 | 12/1985 | Johnson | 2/161.8 |
| 4,757,558 | 7/1988 | Strongwater | 2/244 |
| 4,908,879 | 3/1990 | Roderman | 2/167 |

*Primary Examiner*—C. D. Crowder
*Assistant Examiner*—Amy B. Vanatta
*Attorney, Agent, or Firm*—David L. Baker; Rhodes & Ascolillo

[57] ABSTRACT

The present invention provides a non-slip glove preferably comprising: a front panel conforming generally to the shape of the human hand and having a first peripheral edge extending about the thumb and finger retaining portions thereof, the front panel being cut from a multilayered, laminated, flexible, sheet material wherein a polymer compound, exhibiting a relatively high coefficient of friction, is supported upon an inner fabric layer; a rear panel of breathable, elastic fabric having a hand-like shape substantially similar to that of the front panel and having a second peripheral edge extending about the thumb and finger retaining portions thereof, the first peripheral edge being joined to the second peripheral edge so as to form a covering for the human hand; a cuff secured to the bottom of the front panel and the rear panel; an eyelet lining in the cuff for fastening the glove to a retaining surface so as to prevent the loss thereof; and a light reflective material joined to the rear panel for increasing the visibility of the glove in conditions of low light.

8 Claims, 2 Drawing Sheets

NON-SLIP GLOVE

FIELD OF THE INVENTION

The present invention relates generally to hand coverings and more particularly to a glove suitable for use by individuals who handle large amounts of paper currency and coins to isolate their hands from dirt, grease, bacteria, and other objectionable substances carried thereon and who require an extensive gripping surface.

BACKGROUND OF THE INVENTION

At first glance, most coins and paper currency in circulation today appear to be relatively clean. On closer inspection, however, the exterior surface of our money is often seen to be stained or blemished. On a microscopic level, viruses, microbes and drug residues are present. Such contamination, of course, is expected when one considers the vast number of hands that a given coin or bill passes through during its useful life.

Those individuals who handle large numbers of coins or bills are aware of the fact that, over time, money with its various contaminants tends to discolor their hands. Tellers employed at banks to receive and pay out money over the counter are particularly susceptible to this problem, as are supermarket cashiers. Players of slot machines or gambling devices operated by dropping a coin in a narrow slot also encounter this problem when involved in periods of extended play. The continuous rubbing of coins against the hands is found to produce stains on the hands which cannot be removed readily by soap and water or the usual petroleum-based solvents.

To avoid having their hands soiled, some slot machine players have taken to wearing the plain, unfitted gloves distributed on a complementary basis by some gambling houses. Not only are these complementary gloves generally devoid of any glamour or alluring charm, but they also lack a non-slip surface for easy manipulation of the coins. A need presently exists, therefore, for a stylish glove suitable for use by individuals such as slot machine players who handle large amounts of money in its physical form, which will permit the easy manipulation of the money and simultaneously isolate the hands from objectionable substances.

DESCRIPTION OF THE RELATED ART

Over time, various protective coverings for the hand have been proposed. One of the most enduring has been the glove which includes a separate sheath or stall for each finger and the thumb. A recent addition to the field of glove construction, however, has been the use of multiple layers of material in their construction. It is well known that multi-layered construction increases the usable life of the glove, but other benefits are provided as well.

For instance, U.S. Pat. No. 3,597,765, issued Aug. 10, 1971 to Lari Stanton, provides a sport glove of multi-layered construction for assisting in the gripping function. The glove includes a plurality of gripping strips affixed to its individual finger and thumb retaining sheaths or stalls. The gripping strips extend from the tip of each finger stall and into the palm of the glove. Each gripping strip is separately stitched to the glove's front panel at seams extending around the outer periphery of the strip. Thus, not only is the front panel of the glove incompletely covered by gripping material, but a significant amount of effort is required to mechanically join that material to the glove.

U.S. Pat. No. 4,214,321, issued Jul. 29, 1980 to Elie S. Nuwayser, teaches the use of aluminum film in a glove fabricated from a multilayered, laminate material. The laminated material, adapted for use with organic solvents and other chemicals, includes an outer abrasion-resistant polymer layer, an integral and impermeable aluminum film layer, and an inner heat-sealable thermoplastic layer. The laminated material may be formed into a liquid-impervious glove by cutting the material into two, opposing, hand-shaped panels and heat-sealed together along their peripheral edges.

None of the above inventions, taken either singly or in combination, is seen to describe the instant invention as claimed.

SUMMARY OF THE INVENTION

It is a principal object of the present invention to provide a non-slip glove with a front panel conforming generally to the shape of the human hand which has been cut from a multilayered, laminated, flexible, sheet material wherein a polymer compound, exhibiting a relatively high coefficient of friction, is supported upon an inner fabric layer.

It is an object of the invention to provide a non-slip glove with a rear panel of breathable, elastic fabric having a hand-like shape substantially similar to that of the glove's front panel.

It is an additional object of the present invention to provide a non-slip glove with a cuff secured to the bottom of its co-joined front and rear panels and an eyelet in the cuff for fastening the glove to a retaining surface so as to prevent the inadvertent loss thereof.

Another object of the present invention is to provide a non-slip glove with a light reflective patch joined to its rear panel for increasing the visibility of the glove in conditions of low light.

It is an object of the invention to provide improved elements and arrangements thereof in a non-slip glove for the purposes described which is inexpensive, dependable and fully effective in accomplishing its intended purposes.

These and other objects of the invention will become apparent upon further review of the following specification and drawings.

The present invention, in a preferred embodiment, provides for a non-slip glove having a thumb retaining portion and a plurality of finger retaining portions conforming generally to the shape of a human hand. The non-slip glove comprises a front hand-shaped panel, a rear hand-shaped panel, and a hand opening.

The front hand-shaped panel conforms generally to an outline of the human hand, the panel having a first peripheral edge extending about the thumb and finger retaining portions thereof, and having a front bottom edge. The front hand-shaped panel is cut from a multilayered, laminated, flexible, sheet material wherein a polymer compound, exhibiting a relatively high coefficient of friction, is supported upon one surface of an inner fabric layer.

The rear hand-shaped panel of breathable, elastic fabric has a shape substantially similar to that of the front panel and has a second peripheral edge extending about the thumb and finger retaining portions thereof, and a rear bottom edge. The first peripheral edge is fixedly joined to the second peripheral edge so as to form a seam.

The hand opening has a periphery formed from the front bottom edge and the rear bottom edge.

The polymer compound supported on one surface of a fabric layer is a rubber-like material, such as natural or synthetic rubber.

The non-slip glove further comprises in the preferred embodiment a reflective material joined to the rear panel for increasing the visibility of the glove in conditions of low light. The reflective material is preferably a plurality of sequins, and is in the shape of printed indicia.

The non-slip glove claim 1 still further comprises a cuff secured to the bottom of the front panel and the rear panel, and an eyelet disposed in the cuff for fastening the non-slip glove to a retaining surface so as to prevent the loss of the non-slip glove.

In another aspect, the non-slip glove preferably comprises: a front panel conforming generally to the shape of the human hand and having a first peripheral edge extending about the thumb and finger retaining portions thereof, the front panel being cut from a multilayered, laminated, flexible, sheet material wherein a polymer compound, exhibiting a relatively high coefficient of friction, is supported upon an inner fabric layer; a rear panel of breathable, elastic fabric having a hand-like shape substantially similar to that of the front panel and having a second peripheral edge extending about the thumb and finger retaining portions thereof, the first peripheral edge being joined to the second peripheral edge so as to form a covering for the human hand; a cuff secured to the bottom of the front panel and the rear panel; an eyelet lining in the cuff for fastening the glove to a retaining surface so as to prevent the loss thereof; and a light reflective material joined to the rear panel for increasing the visibility of the glove in conditions of low light.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
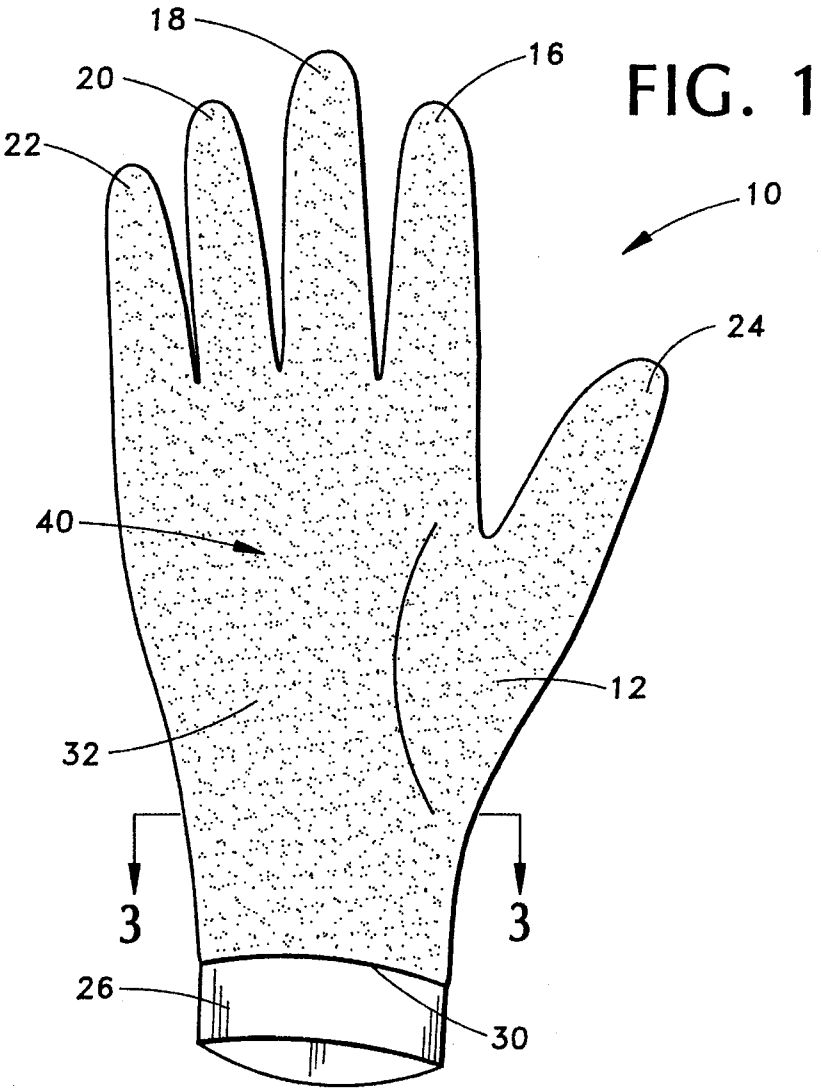
FIG. 1 is a front elevation of a non-slip glove in accordance with the present invention.

Referring now to the figures, a non-slip glove 10 in accordance with the present invention is shown. The major portion of glove 10 is preferably formed from a single pattern which defines the shape of both front panel 12 and rear panel 14. The pattern, generally conforming to the shape of the human hand, may be provided in a variety of sizes to suit the particular needs of the intended wearer, or in a single size to satisfy an individual of average proportions. The pattern includes the finger retaining portions 16, 18, 20, and 22 and thumb retaining portion 24 of the glove, but does not include cuff 26 which may be! formed separately from well known elastic materials and added to the glove 10 for a snug and tailored fit.

Figure 4:
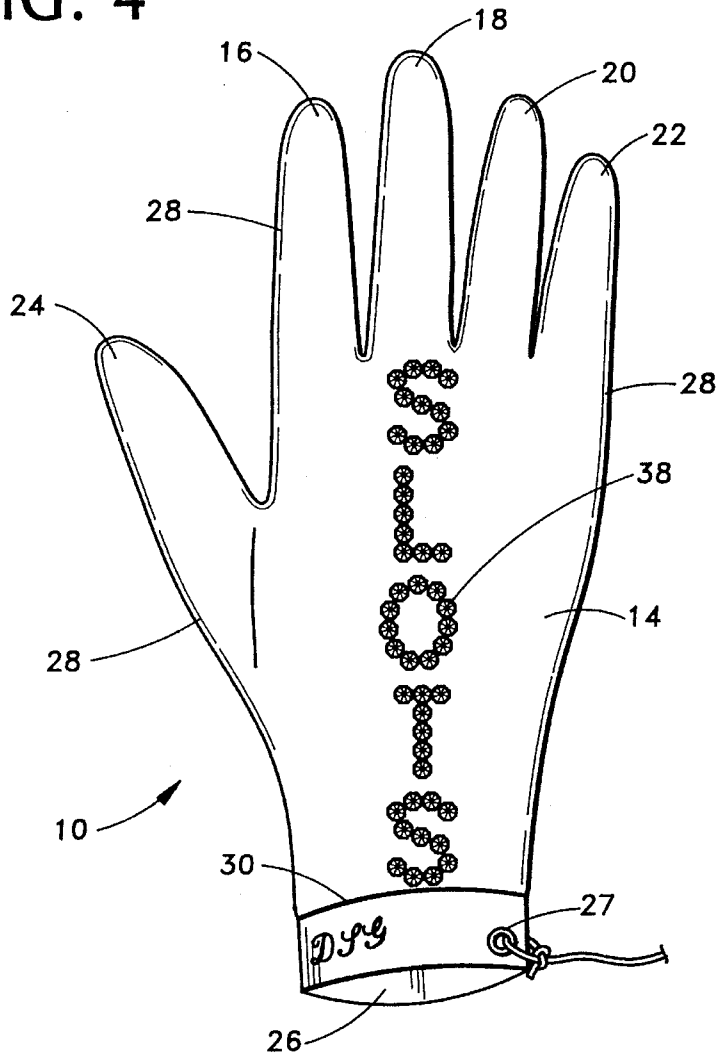
FIG. 4 is a rear elevational view of an alternative embodiment of the invention.

The method of manufacture of glove 10 can be varied, but the preferred method involves the cutting of two separate pieces of fabric from the pattern and bonding together the like halves or blanks, of which one becomes front panel 12 and the other becomes the rear panel 14 of the finished glove 10. Once panels 12 and 14 are placed in substantial alignment, they can be conveniently joined by stitching along their respective peripheral edges extending about the thumb and finger retaining portions of each of panels 12 and 14 so as to form a covering for the human hand. The bottom edges of panels 12 and 14 are not sewn together. After sewing together the front and rear panels, 12 and 14, respectively, a band or cuff 26 for facilitating placement of the glove 10 upon the hand and serving as a finish for the bottom of the glove is secured about the opening formed at the unstitched bottom of the co-joined front and rear panels, 12 and 14, respectively, by stitching along seam 30. As seen in FIG. 4, a metal ring or eyelet 27 is provided in cuff 26 for fastening the glove 10 to a retaining surface (not shown) so as to help prevent the glove's inadvertent loss. Finally, the glove 10 is turned inside out to expose the smooth exterior seam 28.

It is contemplated that stitching need not be used to join front and rear panels, 12 and 14, in all embodiments of the instant invention. Heat sealing may also be employed to construct a unitary glove structure, provided that the materials utilized in front and rear panels, 12 and 14, respectively, are thermoplastic in the sense that they soften on heating yet substantially regain their original durable characteristics upon cooling. Many synthetic textiles on the market today exhibit such characteristics and may be employed with equal facility in the instant invention.

Figure 3:
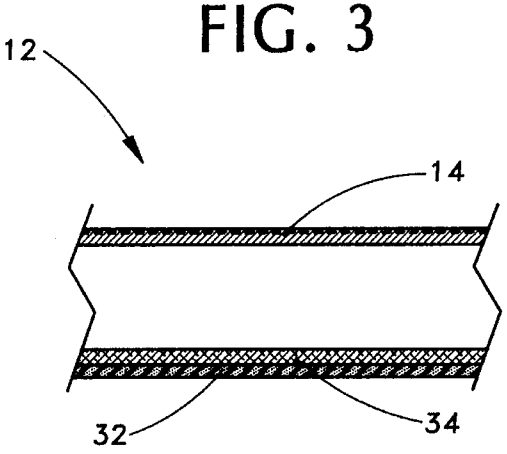
FIG. 3 is a partial cross-sectional view along line 3—3 of FIG. 1 enlarged to show construction details of the glove.

Preferably, the front panel 12 comprises a multilayered, laminated, flexible, sheet material wherein a polymer compound, exhibiting a relatively high coefficient of friction, is supported upon an inner fabric layer. The coefficient of static friction should range in value approximately from 1 to 4. Rubberized cotton is one such sheet material. As may be seen in FIG. 3, the rubberized cotton of the instant invention is formed by the application of a natural or synthetic rubber material 32 to the surface of a flexible cotton sheet 34 using techniques well known in the art so as to form a multilayered material. While it is important that the cotton sheet 34, serving as the materials inner fabric layer, and the rubber polymer 32 be integrally bound together to enhance the structural integrity of the resultant material, it is also important for reasons of comfort that the rubber-like material 32 not be permitted to permeate completely through the cotton sheet 34. If the rubber-like material 32 is first applied to the sheet 34 in liquid or partially liquid form, the careful regulation of pressure, temperature, liquid viscosity, and weave of the cotton fabric will control the passing of rubber-like material 32 through the cotton sheet 34. Similar parameters and conditions must be monitored and controlled if the rubber-like material 32 is joined to cotton sheet 34 by a liquid adhesive, so as to prevent the adhesive from passing completely through the sheet.

A multilayered material, manufactured by the aforementioned coating process would be similar to that described in U.S. Pat. No. 2,606,325, issued Aug. 12, 1952 to Carl A. Neilson et al. Thus, front panel 12 may be formed by such a process which involves the coating of a plasticized polyvinyl chloride sheet with an unplasticized copolymer of ethyl acrylate and acrylonitrile (90 parts to 10 parts, respectively) by spraying the copolymer onto the sheet and allowing the resultant material to dry. An oven may be used to hasten the drying time. The resulting material is disclosed as having a high resistance to irreversible soilage and aging; these properties are similar to the rubberized cotton previously described.

While front panel 12 comprises a non-slip and substantially impermeable material, rear panel 14 includes a breathable, elastic fabric such as one sold under the trademark SPANDEX. The use of SPANDEX fabric is important to the performance of the glove SPANDEX fabric is resistant to perspiration and retains its resilience for extended periods of tim. Additionally, SPANDEX fabric has been found to stretch or elongate to such a degree that the material maintains a form fit and exerts uniform pressure around each finger, thumb, and palm if the glove is properly sized for a given user's hand. Of course, it must be understood that the tensile forces exerted by the SPANDEX fabric, when stretched, should not exceed the forces which would tend to reduce blood circulation in the hand.

It should be appreciated that front and rear panels, 12 and 14 respectively, may be fabricated from materials which exhibit the aforementioned physical properties and which would provide a barrier against dirt, grime, bacteria, chemicals, and the like. It is, of course, preferable that the materials chosen be inexpensive enough to provide a hand covering that is suitable for a wide range of consumers.

Figure 2:
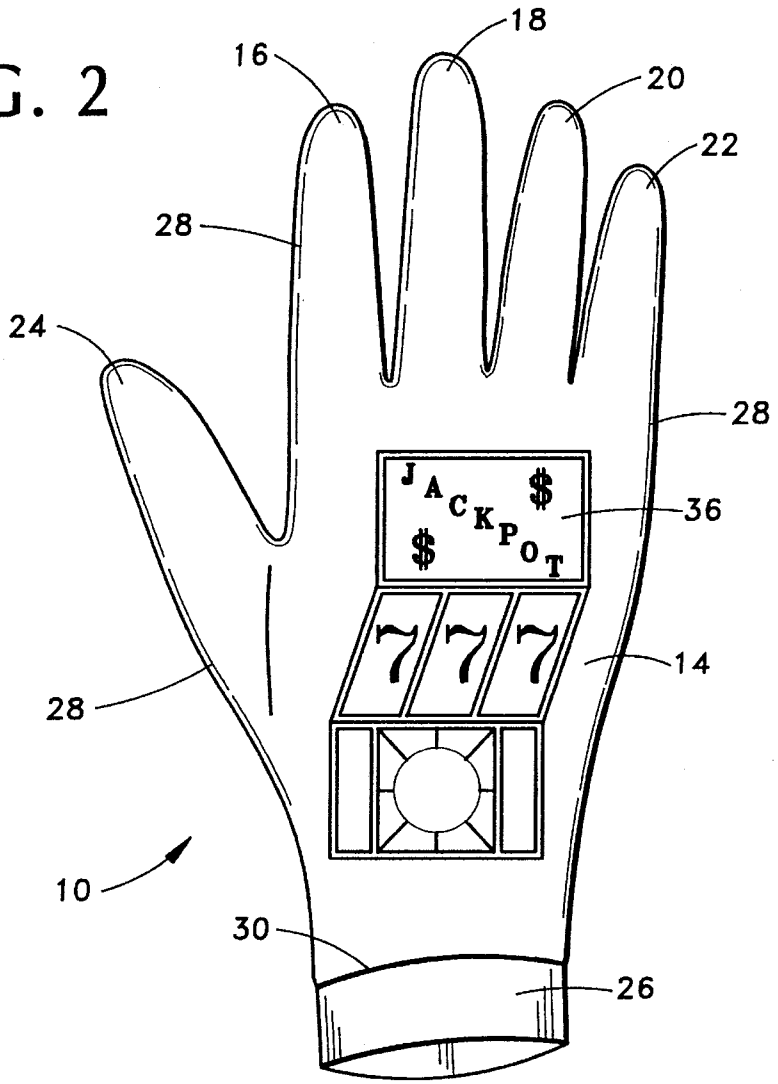
FIG. 2 is a rear elevation of the glove of FIG. 1.

Either a substantially inelastic patch or a substantially elastic patch 36 bearing decorative or other printed indicia may be affixed to the rear panel 14 by stitching or other method. The patch 36 may embody a gambling related symbol such as a slot machine exhibiting a winning combination, as in FIG. 2, or a gambling house logo. The patch could also incorporate sequins or other light reflective surfaces to attract attention to the wearer. Alternatively, the sequins 38 may be sewn or otherwise attached to rear panel 14 directly, as in FIG. 4, in the shape of printed indicia for advertising or other purposes. The sequins 38, having mirrored outer surfaces, further serve to permit the wearer to observe the location of his hands in conditions of low light, such as the dark and dimly lighted atmosphere of many casinos.

As should now be apparent, the glove of the present invention is characterized by a front, exterior surface completely covered with a high friction material. No need exists for tediously cutting and attaching a plurality of gripping overlays to various portions of the glove's front panel to produce such glove, as has been done in the prior art. Of course, the large gripping surface is critical to the use of the present invention since it provides an extensive area for tactile contact with coins or other objects being manipulated in the hand. The glove's gripping surface extends from the tip of each finger and thumb portion, 16, 18, 20, 22, and 24, respectively, of front panel 12 to beyond the base of each finger portion and fully across the palm 40 of the glove 10. Further, rubber-like surface 32 does not directly contact the hand of the user while in use and therefore avoids the direct permeation of perspiration into the rubber-like material 32, which may tend to degrade the rubber-like material over time.

A glove so made may be worn with minimal discomfort, this more particularly in view of the fact that the materials of which it is made are relatively thin, soft, pliable and generally pleasant to the touch. The glove is inexpensive to manufacture, which, from the seller's viewpoint, means that they may be so priced that a prospective purchaser will not hesitate to acquire a pair, or, when necessary, to discard them and purchase replacements. In addition to the rubber-like portion of the glove being substantially incapable of becoming saturated with perspiration, the gloves of the instant invention may be used in a wide variety of operations and may be worn wherever there is a possibility of staining the skin of the hands.

It is to be understood that the present invention may be embodied in other forms and is not limited to the sole embodiment described above, but encompasses any, and all embodiments within the spirit and scope of the following claims. Therefore, the present embodiment must be considered in all respects as illustrative only.

I claim:

1. A non-slip glove having a thumb retaining portion and a plurality of finger retaining portions conforming generally to the shape of a human hand, said non-slip glove comprising:

(a) a front hand-shaped panel conforming generally to an outline of the human hand, having:

a first peripheral edge extending about the thumb and finger retaining portions thereof, and a front bottom edge;

said front hand-shaped panel being cut from a multilayered, laminated, flexible, sheet material wherein a polymer compound, exhibiting a relatively high coefficient of friction, is supported upon one surface of an inner fabric layer;

(b) a rear hand-shaped panel of breathable, elastic fabric having a shape substantially similar to that of said front panel and having:

a second peripheral edge extending about the thumb and finger retaining portions thereof; and a rear bottom edge;

said first peripheral edge being fixedly joined to said second peripheral edge so as to form a seam; and (c) a hand opening having a periphery formed from said front bottom edge and said rear bottom edge.

2. The non-slip glove according to claim 1 wherein said polymer compound is rubber.

3. The non-slip glove according to claim 1 wherein said polymer compound is synthetic rubber.

4. The non-slip glove according to claim 1 further comprising a reflective material joined to said rear panel for increasing the visibility of said glove in conditions of low light.

5. The non-slip glove according to claim 4 wherein said reflective material is a plurality of sequins.

6. The non-slip glove according to claim 4 wherein said reflective material is in the shape of printed indicia.

7. The non-slip glove according to claim 1 further comprising:

(a) a cuff secured to the bottom of said front panel and said rear panel; and (b) an eyelet disposed in said cuff for fastening said non-slip glove to a retaining surface so as to prevent the loss of said non-slip glove.

8. A non-slip glove, comprising:

(a) a front panel conforming generally to the shape of the human hand and having a first peripheral edge extending about the thumb and finger retaining portions thereof, said front panel being cut from a multilayered, laminated, flexible, sheet material wherein a polymer compound, exhibiting a relatively high coefficient of friction, is supported upon an inner fabric layer;

(b) a rear panel of breathable, elastic fabric having a hand-like shape substantially similar to that of said front panel and having a second peripheral edge extending about the thumb and finger retaining portions thereof, said first peripheral edge being joined to said second peripheral edge so as to form a covering for the human hand;

(c) a cuff secured to the bottom of said front panel and said rear panel;

(d) an eyelet lining in said cuff for fastening said glove to a retaining surface so as to prevent the loss thereof; and (e) a light reflective material joined to said rear panel for increasing the visibility of said glove in conditions of low light.

* * * * *